US006252485B1

(12) United States Patent
Lin

(10) Patent No.: US 6,252,485 B1
(45) Date of Patent: Jun. 26, 2001

(54) ROTATION COIL BOBBIN FOR PICTURE TUBE

(76) Inventor: Ching-Jen Lin, No. 217, Min-Sheng Rd., Chi-Chi Town, Nan-Tou Hsien (TW)

( * ) Notice: Subject to any disclaimer, the term of this patent is extended or adjusted under 35 U.S.C. 154(b) by 0 days.

(21) Appl. No.: 09/114,879

(22) Filed: Jul. 14, 1998

(51) Int. Cl.[7] ..... H01F 27/30
(52) U.S. Cl. ..... 336/192; 336/198
(58) Field of Search ..... 335/210, 213; 336/192, 198; 333/440

(56) References Cited

U.S. PATENT DOCUMENTS 4,427,962 * 1/1984 Liberman ..... 336/192
4,546,340 * 10/1985 Kuchuris ..... 336/192
4,588,973 * 5/1986 Grah et al. ..... 336/192
4,672,348 * 6/1987 Duve ..... 336/192
5,058,821 * 10/1991 Yamashita ..... 336/192
5,883,511 * 3/1999 Foster ..... 336/192

* cited by examiner

*Primary Examiner*—Anh Mai
(74) *Attorney, Agent, or Firm*—Bacon & Thomas, PLLC

(57) ABSTRACT

A rotation coil bobbin having two wire holders integral with a peripherally grooved annular base thereof for holding the lead ends of the coil being mounted in the annular base and the electric wires of an electric power connector being connected to the lead ends of the coil, a plurality of upright pins raised from the annular base at the top and spaced between the wire holders for separating the electric wires of the electric power connector, and a hook raised from an inner side wall of the annular base for holding the electric wires of the electric power connector in place.

10 Claims, 4 Drawing Sheets

ROTATION COIL BOBBIN FOR PICTURE TUBE

BACKGROUND OF THE INVENTION

The present invention relates to a rotation coil bobbin for the picture tube of a monitor, and more particularly to such a rotation coil bobbin which has wire holders for holding the lead ends of the coil and the electric wires of an electric power connector being connected to the lead ends of the coil.

FIG. 5 shows a rotation coil bobbin for monitor according to the prior art. This structure of rotation coil bobbin 5 comprises a peripherally grooved annular base 51, which receives a coil 52, a plurality of support arms 6 raised from the base 51 at the top, each support arm 6 having a sloping face 621 fitting the curved peripheral wall of the picture tube behind the screen of the monitor, a double-sided heat-resisting adhesive tape 62 fastened to the sloping face 621 of each support arm 6, a plurality of reinforcing ribs 611 respectively connected between the base 51 and the support arms 6 to reinforce the structural strength of the bobbin 5, an electric socket 63 fixedly fastened to the base 51 at the top to which the two opposite lead ends of the coil 52 are connected, and an electric plug 624 connected to the socket 63 to provide power supply to the coil 52. This structure of rotation coil bobbin is functional, however it is expensive to manufacture. Because the manufacturing cost of the socket 63 and the electric plug 624 is high, the cost of the rotation coil bobbin cannot be greatly reduced.

SUMMARY OF THE INVENTION

According to one aspect of the present invention, two wire holders are integral with the top side wall of the bobbin for receiving the lead ends of the coil mounted thereon and the electric wires of the electric power connector being connected to the lead ends of the coil. According to another aspect of the present invention, a hook is raised from an inner side wall of the bobbin for securing the electric wires of the electric power connector in place when the electric power connector is connected to a power supply outlet.

DETAILED DESCRIPTION OF THE PREFERRED EMBODIMENT

Figures 1, 1A:
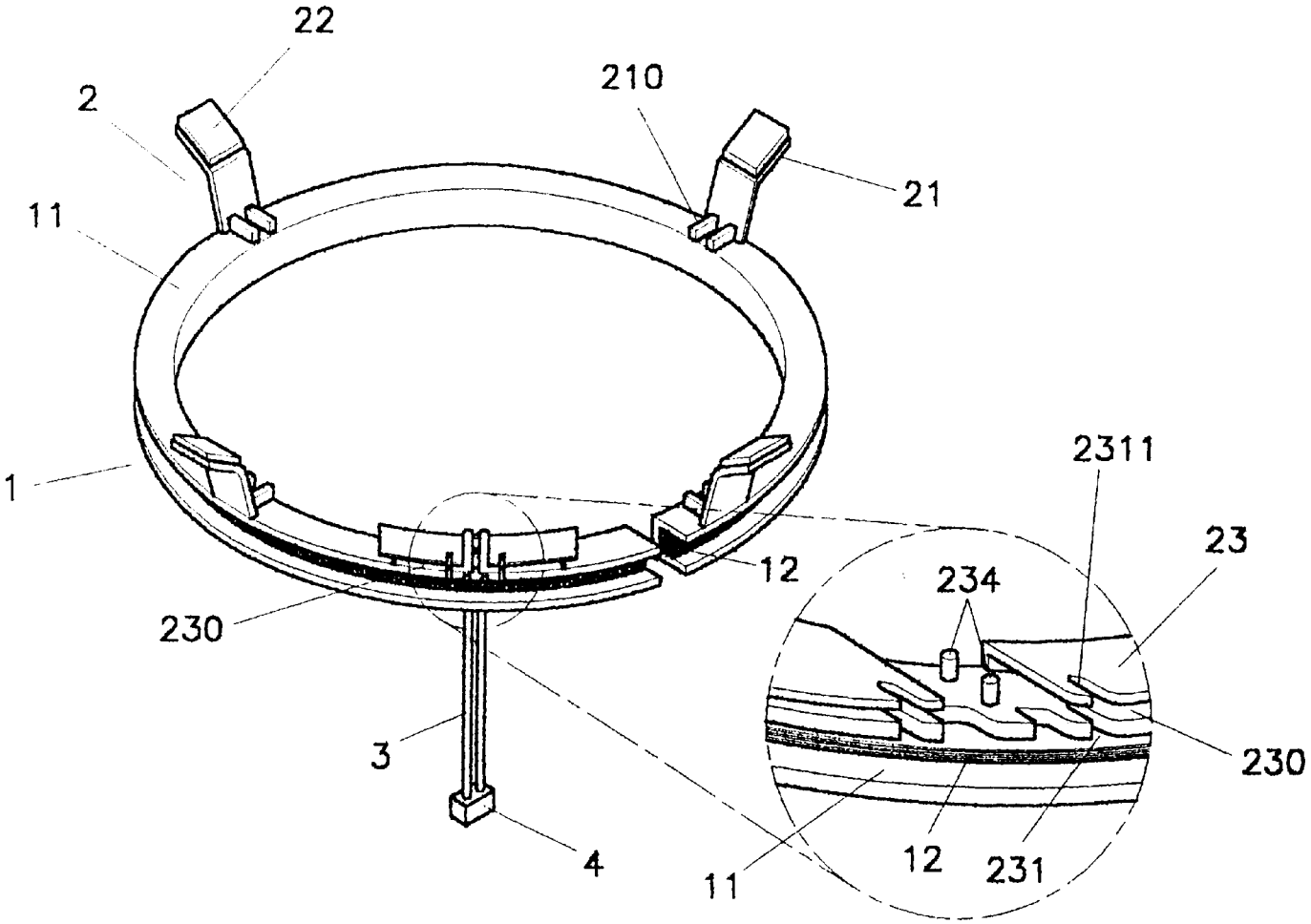
FIG. 1 is a perspective view of a rotation coil bobbin according to the present invention.
FIG. 1A is an enlarged view of a part of FIG. 1.

Referring to FIGS. 1 and 1A, a rotation coil bobbin 1 in accordance with the present invention is generally comprised of a peripherally grooved annular base 11, which holds a coil 12, and a plurality of support arms 2 raised from the base 11. Each support arm 2 has a sloping face 21 fitting the curved peripheral wall of the picture tube behind the screen of the monitor. A double-sided heat-resisting adhesive tape 22 is fastened to the sloping face 21 of each support arm 2. A plurality of reinforcing ribs 210 are respectively connected between the base 11 and the support arms 2 to reinforce the structural strength of the bobbin 1.

Figure 3:
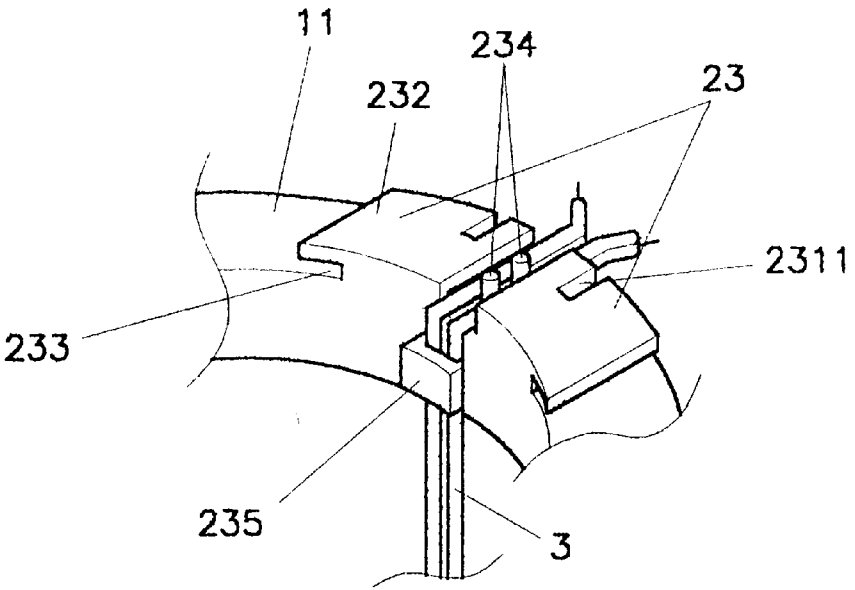
FIG. 3 is similar to FIG. 2 but showing the lead wires installed.
Figure 2:
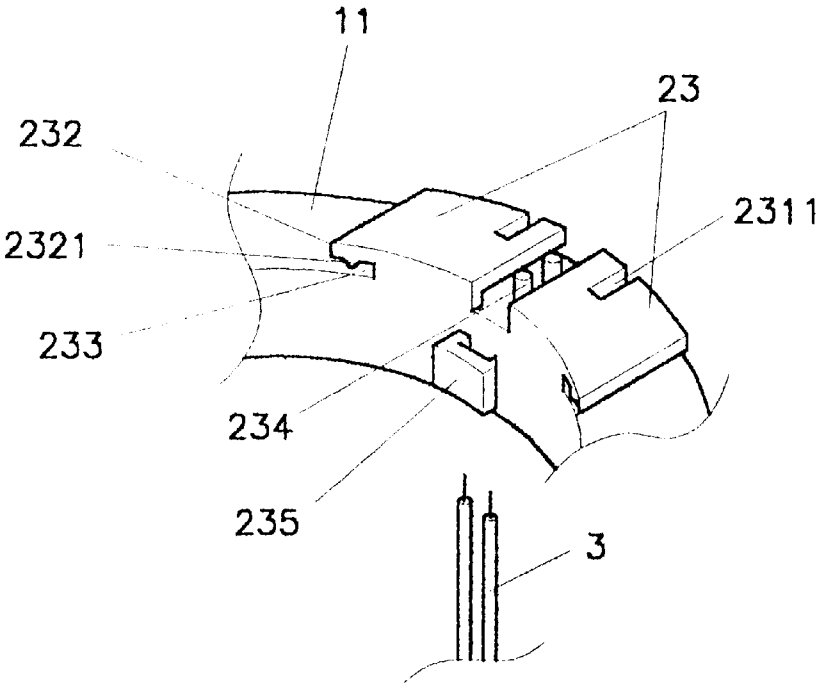
FIG. 2 is an enlarged view of a part of the present invention, showing the structure of the wire holder.

Referring to FIGS. 2 and 3 and FIGS. 1 and 1A again, two wire holders 23 are integral with the base 11. Two upright pins 234 are raised from the base 11 at the top and equally spaced between the wire holders 23. Each wire holder 23 comprises a channel 230 in parallel to the base 11, a bottom notch 2311 and a top notch 231 at top and bottom sides of the channel 230, a flange 232 suspended above the base 11 at one side, a groove 233 defined between the flange 232 and the base 11 (see FIG. 3). As an alternate form of the present invention, a projecting portion 2321 may be raised from the bottom side wall of the flange 232 (see FIG. 2). Further, a hook 235 is provided at an inner side of the base 11 adjacent to the wire holders 23.

Referring to Figures from FIGS. 1 through 3 again, two electric wires 3 are respectively connected to a connector 4. The opposite ends of the electric wires 3 are respectively connected to the two opposite lead ends of the coil 12. When the lead ends of the coil 12 and the electric wires 3 are connected together, the lead ends of the coil 12 are respectively inserted through the bottom notches 231, permitting the connections between the lead ends of the coil 12 and the electric wires 3 to be received in the channels 230 of the wire holders 23, and then the electric wires 3 extended out of the channels 230 of the wire holders 23 and separated by the upright pins 234 and then secured in place by the hook 235. Alternatively, the electric wires 3 can be respectively inserted through the channels 230 and then the grooves 233. The design of the top notches 231 enables the work man to conveniently set the electric wires 3 and the lead ends of the coil 12 into position.

When in use, the rotation coil bobbin 1 is mounted around the neck of the picture tube of the monitor, then adjusted to the correct position, and then the stripping film of each double-sided heat resisting adhesive tape 22 is removed, enabling each double-sided heat resisting adhesive tape 22 to be adhered to the periphery of the picture tube.

Figure 4:
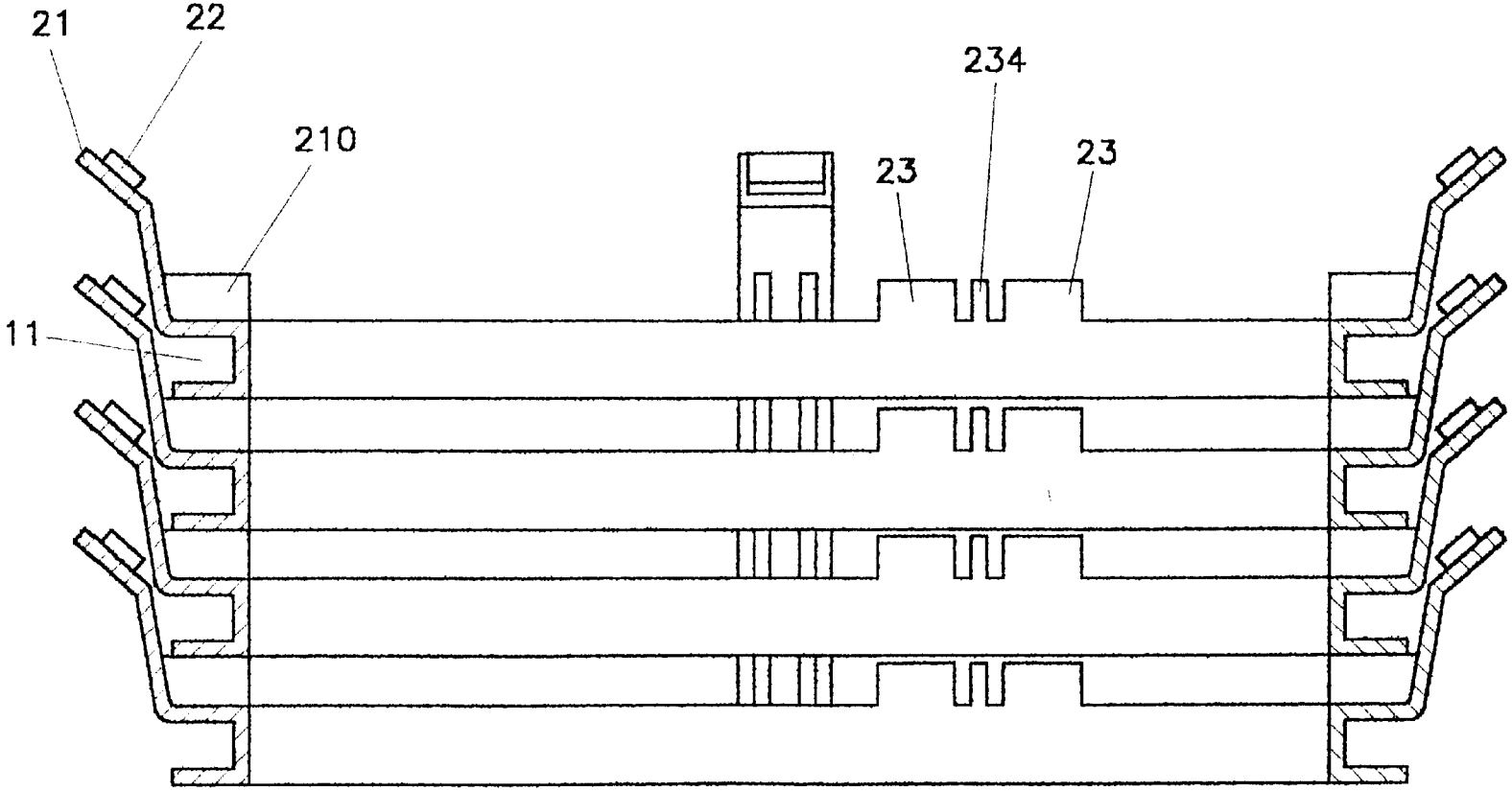
FIG. 4 is a sectional view in an enlarged scale of the present invention.
Figure 5:
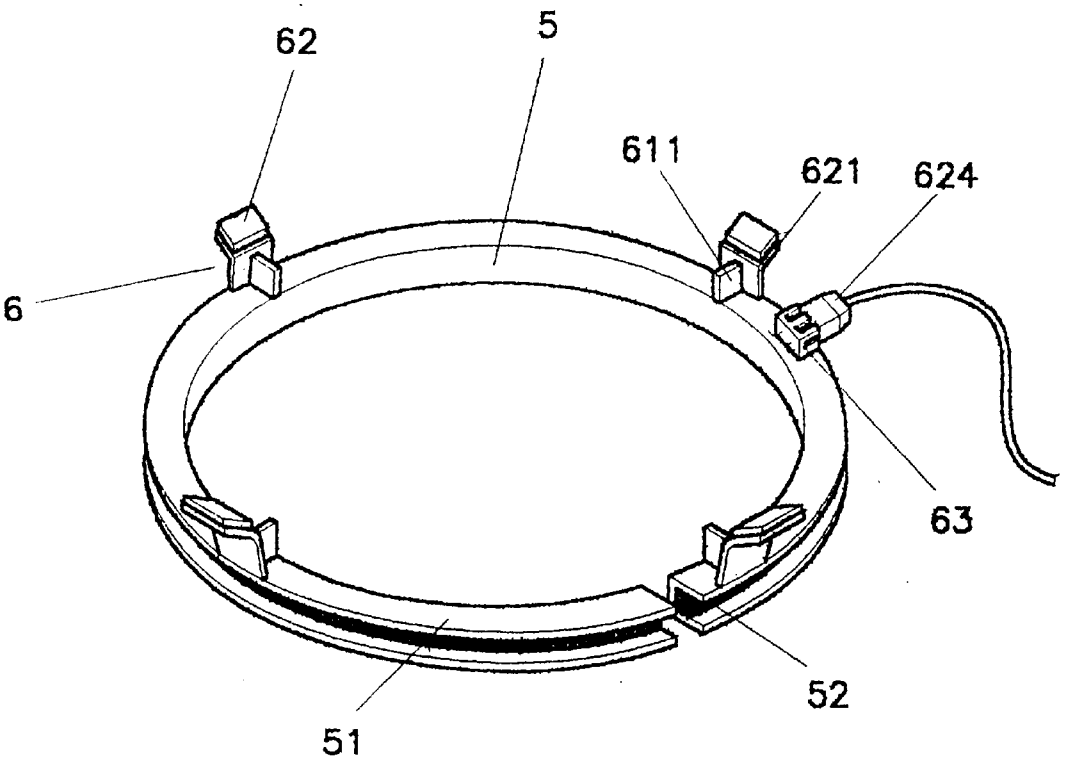
Fig. 5 (PRIOR ART)
FIG. 5 is a perspective view of a rotation coil bobbin according to the prior art.

Referring to FIG. 4, when a plurality of rotation coil bobbins 1 are produced, they can be conveniently arranged in a stack to minimize storage space.

While only one embodiment of the present invention has been shown and described, it will be understood that various modifications and changes could be made thereunto without departing from the spirit and scope of the invention disclosed.

What the invention claimed is:

1. A rotation coil bobbin, comprising:

a peripherally grooved annular base having a top side wall and an inner side wall;

a plurality of support arms raised from the top side wall of said annular base for securing said annular base to a picture tube;

a coil mounted around said annular base;

an electric power connector having two electric wires respectively connected to two opposite lead ends of said coil;

two wire holders raised from the top side wall of said annular base for holding the lead ends of said coil and the electric wires of said electric power connector in place;

a plurality of upright pins raised from the top side wall of said annular base and spaced between said wire holders for separating the electric wires of said electric power connector; and a hook raised from the inner side wall of said annular base for holding the electric wires of said electric power connector in place.

2. The rotation coil bobbin of claim 1 wherein said wire holders each comprise a channel for receiving the connection portions between the lead ends of said coil and the electric wire of said electric power connector.

3. The rotation coil bobbin of claim 2 wherein said wire holders each comprise a bottom wire notch at a bottom side of the respective channel.

4. The rotation coil bobbin of claim 3 wherein said wire holders each comprise a top notch at a top side of the respective channel corresponding to the respective bottom wire notch.

5. The rotation coil bobbin of claim 1 wherein said wire holders each comprise an outward flange suspended above the top side wall of said annular base at an outer side and defining with the top side wall of said annular base a wire groove.

6. The rotation coil bobbin of claim 5 wherein the outward flange of each of said wire holders has a projecting portion at a bottom side facing the top side wall of said annular base.

7. The rotation coil bobbin of claim 6 wherein said wire holders each comprises a bottom wire notch at a bottom side of the respective channel.

8. The rotation coil bobbin of claim 7 wherein said wire holders each comprises a top notch at a top side of the respective channel corresponding to the respective bottom wire notch.

9. The rotation coil bobbin of claim 5 wherein said wire holders each comprises a bottom wire notch at a bottom side of the respective channel.

10. The rotation coil bobbin of claim 9 wherein said wire holders each comprises a top notch at a top side of the respective channel corresponding to the respective bottom wire notch.

* * * * *